United States Patent [19]

Olmsted

[11] 4,026,193

[45] May 31, 1977

[54] HYDRAULICALLY DRIVEN HAMMER SYSTEM

[75] Inventor: Peter B. Olmsted, Traverse City, Mich.

[73] Assignee: Raymond International Inc., Houston, Tex.

[22] Filed: Sept. 19, 1974

[21] Appl. No.: 570,425

[52] U.S. Cl. ..... 91/216 B; 91/291; 94/321; 137/596.14; 137/625.6

[51] Int. Cl.[2] ..... F01L 25/06; F01B 7/18; F01B 15/00

[58] Field of Search ..... 91/291, 216 B, 321, 91/300; 137/596.14, 596.15, 625.6, 596.18

[56] References Cited

UNITED STATES PATENTS

| | | | |
|---|---|---|---|
| 1,430,764 | 10/1922 | Smith | 91/300 |
| 1,709,093 | 4/1929 | Farrell | 91/216 B |
| 2,611,391 | 9/1952 | Sainsbury et al. | 137/596.15 |
| 2,853,057 | 9/1958 | McAuley | 91/300 |
| 3,322,038 | 5/1967 | Dobson | 91/291 |
| 3,437,011 | 4/1969 | Gelder | 137/596.18 |
| 3,552,269 | 1/1971 | Arndt | 91/291 |
| 3,582,039 | 6/1971 | Cagle | 251/129 |

*Primary Examiner*—Paul E. Maslousky
*Attorney, Agent, or Firm*—Fitzpatrick, Cella, Harper & Scinto

[57] ABSTRACT

A hydraulic pile driving hammer system is described which requires only a single pressure operated pilot to obtain switching for reversal of hydraulic forces at both ends of its stroke.

12 Claims, 6 Drawing Figures

HYDRAULICALLY DRIVEN HAMMER SYSTEM

BACKGROUND OF THE INVENTION

1. Field of the Invention

This invention relates to hydraulic devices and more particularly it concerns a novel hydraulically driven hammer system.

2. Description of the Prior Art

Fluid driven pile driving hammers are known in the prior art. Examples of these are shown in U.S. Pat. Nos. 3,298,447; 3,417,828 and 3,431,986. These pile driving hammers have a piston and cylinder arrangement either attached to or incorporated with a massive moveable ram. Hydraulic fluid is switched by valve means to flow into and out from the cylinder on opposite sides of the piston. In this manner reciprocal movement is produced between the piston and cylinder; and this drives the ram up and down. The switching of the hydraulic valve means in some of these prior art systems is obtained by exposing a pilot conduit to a surface over which a land separating regions of different pressure moves. In this prior art systems this land is the piston itself and the pilot conduit opens into the cylinder at a location over which the piston passes. As the piston moves over the pilot conduit opening the pressure to which the pilot conduit is exposed changes and this pressure change is sensed and used to switch the hydraulic valve means.

A difficulty arises in the prior art due to the fact that along the length of the piston or land which separates regions of different hydraulic pressure there exists a pressure gradient; and the precise location at which the pressure level causes switching is therefore not ascertainable. A further difficulty arises from the fact that the prior art systems require separate pilot conduits and associated pilot systems to produce switching at both ends of the hammer stroke. Moreover, since the hydraulic switching itself causes pressure changes in the region being sensed by the pilot conduit, rather elaborate arrangements were necessary in the prior art to prevent further switching in response to these pressure changes.

SUMMARY OF THE INVENTION

Accordingly to the present invention there is provided a reciprocally driven hydraulic hammer system in which switching takes place at a proper point in the course of the hammer ram stroke to effect reversal at both ends of the stroke using only a single pressure sensing pilot arrangement. This is achieved according to the present invention by the provision of a land which is slideable along a surface as the ram moves in the hammer. The land is arranged such that relative sliding movement occurs between the land and the surface as the hydraulic system is driven. The land moreover is arranged to separate regions of different fluid pressure. A pilot conduit opens out onto the portion of the land surface facing the land so that the land moves back and forth over the open end of the conduit, or vice versa, upon reciprocal movement of the ram so that the open end of the conduit successively becomes exposed to the different pressure regions on opposite sides of the land. A hydraulic switching valve means is provided to reverse the hydraulically driven system in response to the exposure of the pilot conduit to the different pressures.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of our structures for carrying out the several purposes of the invention. It is important, therefore, that the claims be regarded as including such equivalent constructions as do not depart from the spirit and scope of the invention.

BRIEF DESCRIPTION OF THE DRAWINGS

A specific embodiment of the invention has been chosen for purposes of illustration and description, and are shown in the accompanying drawings, forming a part of the specification wherein.

DESCRIPTION OF THE PREFERRED EMBODIMENTS

Figures 1, 2:
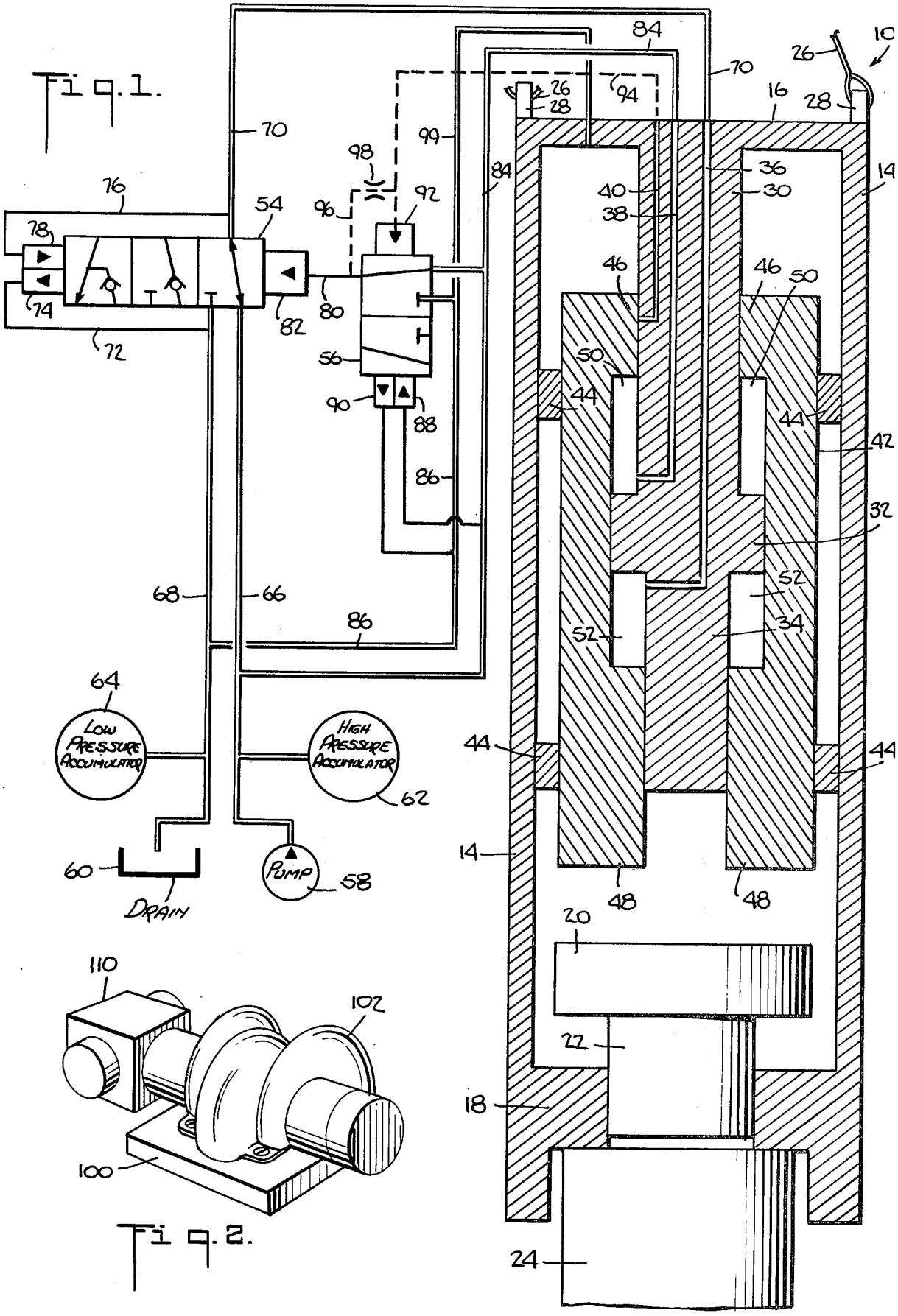
FIG. 1 is a diagramtic view showing a hydraulic pile driving hammer system in which the present invention is embodied.
FIG. 2 is a perspective view of the external configuration of a valve assembly used in the hammer system of FIG. 1.

The hydraulic hammer assembly of FIG. 1 comprises a hammer portion 10 and a hydraulic drive and switching portion 12. The hammer portion is made up of a hollow tubular outer casing 14 which is closed at its upper end by a top plate 16 and is partially closed at its bottom end by a bottom flange section 18. An anvil 20 is provided inside the casing 14 near the bottom; and this anvil has a stem 22 which projects down through an opening in the flange section 18. As shown, the flange section 18 rests on top of a pile 24 or a pile driving cap block, if necessary. The anvil stem 22 is moveable through the flange section 18 to the pile 24 to transmit hammer driving blows on the anvil 20 down to the top of the pile 24. The outer casing 14 is suspended from a hammer rig (not shown) by means of cables 26 secured to anchors 28 at the top of the casing.

A stationary piston arrangement is provided within the outer casing 14. This stationary piston arrangement comprises an intermediate diameter upper stem portion 30 secured to an extending down from the middle of the top plate 16 into the outer casing 14, a large diameter central stem portion 32 extending down from the upper stem portion and a smaller diameter lower stem portion 34 extending down from the central portion 32. An alternate pressure fluid flow conduit 36, a high pressure fluid flow conduit 38 and a pilot conduit 40 each extend down from the top plate 16 through the interior of the stationary piston arrangement. The alternate pressure fluid flow conduit opens out onto the surface of the lower portion 34 just below the central stem portion 32; and the high pressure fluid flow conduit opens out onto the surface of the upper stem portion 30 just above the central stem portion 32. The pilot conduit 40 also opens out onto the surface of the upper stem portion 30 art an intermediate location along its length.

A massive cylinder ram 42 is provided inside the tubular outer casing 14 and is guided for reciprocal movement up and down therein by means of slide bearings 44. The cylinder ram 42 is hollow and it encircles the stationary piston arrangement. The central interior region of the cylinder ram is of substantially the same diameter as the larger diameter central stem portion 32 of the stationary piston arrangement. The upper and lower regions of the cylinder ram are formed as upper and lower lands 46 and 48 which slide over the upper and lower piston stem portions 30 and 34 respectively as the cylinder ram moves up and down. It will be seen that this construction forms upper and lower fluid chambers 50 and 52 within the cylinder ram 42 which change volume in inverse relation to each other as the cylinder ram moves up and down. It will be noted that because the lower piston stem portion 34 is of smaller diameter than the upper piston stem portion 30, the diametrical area of the lower fluid chamber 52 is larger than that of the upper fluid chamber 50.

The length of the central interior region of the cylinder ram 42 is sufficient to allow the ram to move up and down over the large diameter cential stem portion 32 of the stationary piston arrangement and to impact the anvil 20 at the bottom of each stroke. The cylinder ram upper land 46 is located to slide over the opening of the pilot conduit 40 so that at the lower end of the cylinder ram stroke the pilot conduit 40 becomes exposed to the fluid pressure in the outer casing 14 above the cylinder ram and at the upper end of the cylinder ram stroke the pilot conduit 40 becomes exposed to the fluid pressure in the upper fluid chamber 50. Means (not shown) are provided to maintain the interior of the casing 14 filled with hydraulic fluid at low pressure, i.e., drain pressure. The slide bearings 44 are spaced apart circumferentially about the interior of the casing to allow flow of this fluid around the cylinder ram as it moves up and down.

The hydraulic drive and switching portion 12 comprises a main drive valve 54, a pilot valve 56, a pump 58, and drain reservoir 60, and high and low pressure accumulators 62 and 64 along with various hydraulic interconnections described herein. The pump 58 is connected via a first pump output line 66 to one input of the main drive valve 54; while the drain reservoir 60 is connected via a drain line 68 to a second input of the main drive valve 54.

The terms "output" and "input" as applied to the valves 54 and 56 do not refer to whether fluid is flowing into or out from the valve but instead these terms refer to whether a particular conduit connection to the valve leads to a fluid source or to a fluid utilization means. Thus the main drive valve 54 has two inputs, one from the first pump output line 66 and the other from the drain line 68. In addition the main drive valve 54 has a single output to the main drive line 70.

The main drive valve 54 is diagramatically shown to have three positions. In the first position as shown the valve connects the pump output line 66 to the main drive line 70. In its intermediate position the valve 54 serves as a check valve between the main drive line 70 and the first pump output line 66. In its extreme opposite position the main drive valve 54 connects the drain line 68 to the main drive line 70.

The main drive valve is operated by pilot pressure operating to move it from one position to the other. A drain pilot line 72 connects the drain line 68 to a first pilot connection 74, a main drive pilot line 76 connects the main drive line 70 to a second pilot connection 78 and a control pilot line 80 connects an output from the pilot valve 56 to a third pilot connection 82.

A second pump output line 84 connects the output from the pump 58 to one input to the pilot valve 56 while a second drain line 86 connects the drain 60 to another input to the pilot valve 56. The pilot valve 56 is diagramatically shown to have two positions. In the first position, as shown, the pilot valve connects the second pump output line 84 to the control pilot line 80 and in its opposite position, the pilot valve connects the second drain line 86 to the control pilot line 80.

The pilot valve 56 itself is operated by pilot pressure to move it from one position to the other. First and second pilot valve pilot inputs 88 and 90 are connected respectively to the second pump output line 84 and the second drain line 86. A third pilot valve pilot input 92 is connected via a pilot valve control line 94 to the pilot conduit 40 in the hammer portion 10. A compensating feedback line 96 connects the pilot valve output, i.e., the control pilot line 80 to the pilot valve control line 94. The feedback line 96 is shown to include a flow limiting restriction 98 for latching and leakage compensation purposes as will be explained more fully hereinafter.

Finally, the second pump output line 84 is also connected to the high pressure fluid flow conduit 38 in the hammer portion 10; while the second drain line 86 is connected via a casing drain line 99 to the interior of the casing 14. With this last mentioned connection, the interior of the casing 14 is maintained filled with hydraulic fluid and the low pressure accumulator is enabled to accomodate the fluid displacements within the casing which occur as the cylinder ram 42 moves up and down.

During operation of the system of FIG. 1, the hydraulic drive and switching portion causes the cylinder ram 42 in the hammer portion 10 to be driven up and down inside the tubular outer casing 14. At the bottom of each downstroke the ram 42 impacts the anvil 20 causing its stem 22 to drive down on the pile 24.

The ram movement is caused by switching the hydraulic forces applied to the upper and lower hydraulic chambers 50 and 52. As can be seen, because of the connections via the high pressure fluid flow conduit 38 and the second pump output line 84, the upper hydraulic chamber 50 is at all time maintained in communication with the pump output. The lower hydraulic chamber 52 on the other hand is connected via the alternate pressure fluid flow conduit 36 and the main drive line 70 to the output of the main hydraulic valve 54 which, upon switching, alternately places the lower chamber 52 into communication with the pressures of the high and low pressure accumulators (hereinafter referred to as pump and drain pressures, respectively).

When the lower chamber 52 is at drain pressure, the hydraulic forces applied to it are overcome by the high pump pressure being supplied to the upper chamber 50. As a result, the cylinder ram 42 is driven upwardly. Thereafter, when the main hydraulic valve 54 is switched to place the lower chamber 52 at pump pressure, its larger diametrical area results in a greater hydraulic force which overcomes that being produced by the same pump pressure in the smaller diametrical area upper chamber 50. This force differential results in a net downward force on the ram; and this in turn produces decelerations of the upward ram movement and eventual downward movement and acceleration of the ram.

The main drive valve 54 alternately connects the lower chamber 52 to pump pressure and to drain pressure by switching between its extreme positions in which it places the main drive line 70 into alternate communication with the pump output and drain lines 66 and 68.

It will be noted that while both moving toward and residing at the extreme position opposite to that shown in FIG. 1, the main drive valve 54 provides a check valve function which enables excessive pressure surges in the main drive line 70, caused by inertia effects of the massive cylinder ram 42, to be accommodated by fluid flow toward the pump 58. The main drive valve 54 is moved to the position shown in FIG. 1 by application of pump pressure to its third pilot connection 82; and it is moved to its opposite position by application of drain pressure to its third pilot connection 82. The feedback supplied via the drain pilot line 72 and the main drive pilot line 76 serves to provide light latching and extremely fast switching as will be explained more fully hereinafter.

The pilot valve 56 is switched to cause switching of the main drive valve 54 by alternate application of pump and drain pressure through the pilot valve control line 94 to the third pilot valve pilot input 92. Pump pressure is supplied to the line 94 near the top of the cylinder ram upstroke when the pilot conduit 40 opens below the upper cylinder land 46 to the pressurized upper fluid chamber 50. Drain pressure is supplied to the line 94 toward the bottom of the cylinder ram downstroke when the pilot conduit 40 opens above the upper cylinder land 46 to the drain pressurized interior of the outer casing 14. The pressure and drain connections to the first and second pilot valve pilot inputs 88 and 90 serve to balance the valve for easy movement from one position to another and to accommodate the fluid displacements which accompany valve actuation.

It will be appreciated that because of the construction of the hammer portion 10 and the arrangement of the pilot conduit 40, this conduit successively and alternately opens to two regions, i.e., pressurized upper chamber 50 and the drain connected interior of the outer casing 14. Moreover, the pressures in these two regions do not change as a result of valve switching so that no special interlock arrangements are required to hold the pilot valve 56 in position following its switching.

It will also be appreciated that since the pilot conduit 40 opens to different regions toward opposite ends of the raam stroke only a single pilot conduit 40 is required to provide switching at both ends of the ram stroke. The timing of this switching, and length of ram stroke, depends upon the length of the upper land 46 of the cylinder ram 42 in the direction of ram stroke. By increasing the length of the land the stroke length will be increased because the switching points will be moved farther apart.

The ram stroke can also be lengthened by increasing hydraulic pump pressure. This will cause the ram to rise at an increased velocity so that after switching the inertia of the ram will carry it to a greater height before the reversed hydraulic forces can overcome the upward ram momentum and being to force it downwardly. The switching which occurs to cause the downstroke should, in general, occur about midway through the upstroke. The switching which occurs to cause the upstroke, however, should take place at or immediately before the end of the downstroke. This insures that the ram will impact the anvil at its highest velocity.

It will be noted that no seals are provided between the upper stem portion 30 of the stationary piston and the cylinder ram land 46 which slides over it. Thus, wear between the piston and cylinder is reduced to a minimum. However, no sudden pressure change occurs anywhere across the length of the land 46. Instead the pressure varies gradually along the length of the land from pump pressure near the upper chamber 50 to drain pressure near the casing interior. This gradual pressure variation is accompanied by a gradual steady leakage of fluid from the chamber 50 to the casing interior. The novel pilot control arrangements herein serve to provide precise valve switching and to hold the pilot valve in position between switching operations even though the pilot conduit 40 and the pilot valve control line 94 are exposed to a constantly changing pressure and a constant fluid leakage toward the interior of the casing 14.

When the cylinder ram 42 is being driven downwardly the main drive valve 54 and the pilot valve 56 are in their positions shown in FIG. 1. Both valves are maintained in these positions by the maintenance of fluid at high pressure in their respective pilot connection or input 82 and 92. High pressure at the connection 82 of the main drive valve is maintained through the pilot valve 56. The pilot input 92 of the pilot valve 56 however is subject to leakage of fluid from the pilot valve control line 94 and the pilot conduit 40 into the region between the land 46 and the upper piston stem portion 30. The pilot 92 is also subjected to a gradual pressure reduction as the ram 42 moves downwardly and the pilot conduit 40 approaches the top of the upper land 46. These flow and pressure variations are compensated for by the compensating feedback line 96 and the flow limiting restriction 98 which meter a high pressure flow of fluid back to the pilot valve control line 94 to compensate for the leakage taking place. In addition, the constant pressure afforded at the output of the pilot valve 56 and the close metering of the restriction 98 serves to maintain a substantially constant pressure at the pilot input 92. Now, when the ram 42 reaches the bottom of its stroke and the pilot conduit 40 becomes exposed to the interior of the casing 14 there is no longer any restriction in the lines 94 and 40 between the pilot input 92 and the interior of the casing 14 and fluid may flow freely out from the pilot valve input. Also, because of the restriction 98 the compensating flow from the valve output via the feedback line 96 is insufficient to compensate for this outflow; and as a result the pilot valve 56 switches to its opposite position. This connects the third pilot connection 82 of the main drive valve 54 to drain pressure and thereby cause the main drive valve 54 to change position and to begin the cylinder ram upstroke.

During the ram upstroke the pilot valve 56 is held in its upper position by drain pressure in its pilot input 92. During this time, however, the pilot input 92 is subject to a gradually increasing pressure and a leakage of fluid in its direction as the pilot conduit 40 approaches the bottom of the land 46. Again, this pressure variation and fluid leakage are compensated for by feedback from the drain connected pilot valve output through the feedback line 96 and the flow limiting restrictor 98.

It will thus be appreciated that the compensating feedback line 96 and flow limiting restriction 98 cooperate to provide valve latching in two positions and to render the valve more accurately responsive to the passage of the cylinder land 46 over the pilot conduit 40.

The perspective view of FIG. 2 shows the exterior of a valve assembly which houses both the main drive valve 54 and the pilot valve 56. As can be seen in FIG. 2, this assembly includes a flat base plate 100 containing ports which lead to the pump output and drain lines and to the alternate and high pressure fluid flow conduits 36 and 38 and the pilot conduit 40 (FIG. 1) of the hammer portion 10. Actually, the plate 100 may be secured directly to the top plate 16 of the hammer portion so that the lines 70 and 94 in practice are reduced to effectively zero length. In such case the lines 66, 68, 84 and 86 may be brought in through conduits formed in the top plate 16.

A housing 102 is formed on top of the plate 100 and this housing is formed with various internal passageways to accommodate fluid flows and to accommodate switching spool means to be described hereinafter.

Figure 3:
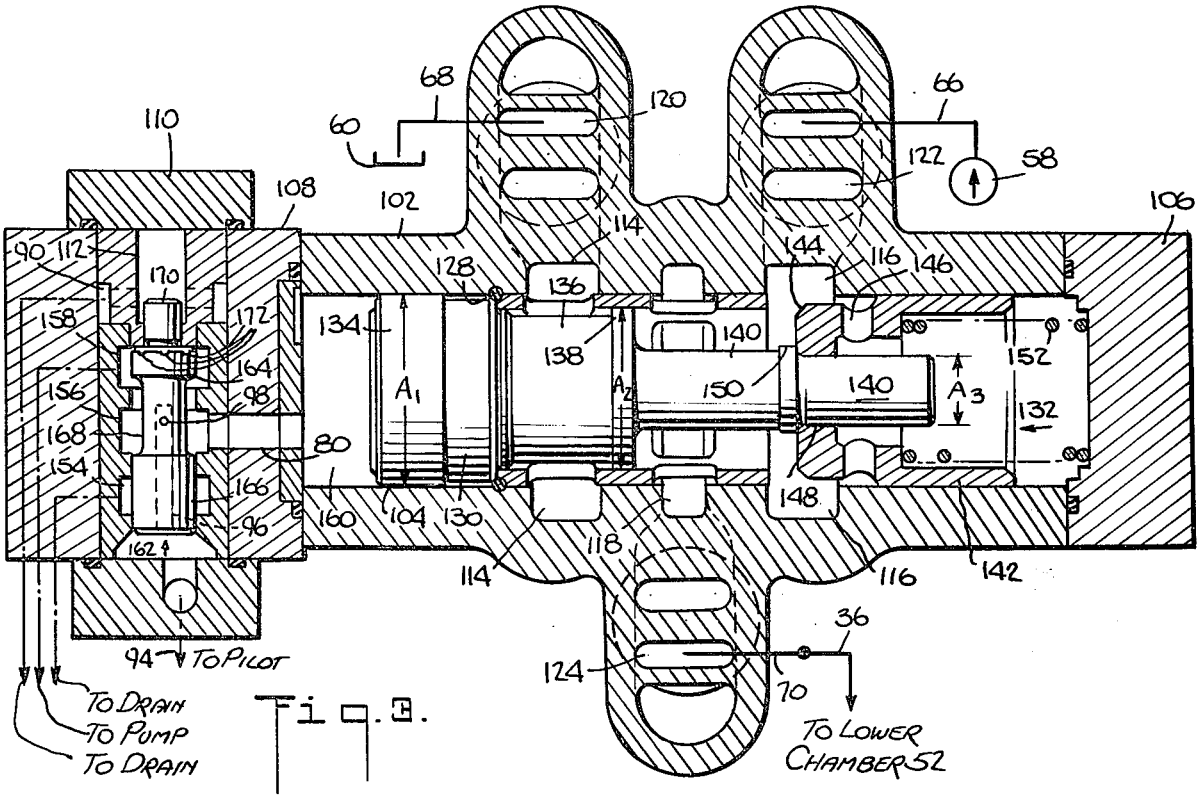
FIGS. 3–6 are enlarged section views taken along lines 3—3 of FIG. 2, and showing, respectively, the different positions taken by the different valve assembly elements during various stages in the operating cycle of the hammer system of FIG. 1.

The interior configuration of the housing 102 and the valve assembly is shown in the section view of FIG. 3. This valve assembly, per se, forms a separate invention and is described and claimed in a copending application Ser. No. 507,419, filed Sept. 19, 1974 now abandoned. As can be seen, the housing 100 is formed with a longitudinal main valve bore 104 closed at one end by a front plate 106 and closed at the opposite end by a back plate 108. The back plate 108 serves as a portion of a housing extension 110 which itself is formed with a pilot valve bore 112. An annular drain input recess 114 and an annular pressure input recess 116 are formed at axially displaced locations in the main bore 104; and a common annular output recess 118 is also formed in the bore 104 between the drain and pressure recesses 114 and 116. The drain input recess 114 communicates with a drain input port 120 to which the drain line 68 is connected. The pressure input recess 116 communicates with a pressure input port 122 to which the pressure line 66 is connected; and the output recess 118 communicates with a drive output port 124 to which the main drive line 70 and the alternate pressure fluid flow conduit 36 are connected.

A stationary sleeve 126 is fitted into the main bore 104 and extends across the lands separating the drain, output and pressure recesses 114, 118 and 116 to form smaller diameter cross sections of the bore 104 in these regions. The sleeve 126 also extends a short distance beyond the drain recess 118 toward the back plate 108 and a sealing O-ring 128 is fitted into the corner formed where the back edge of the sleeve 126 meets the bore wall.

A main valve spool assembly comprising a drain control portion 130 and a pressure control portion 132 is provided in the bore 104. The main control portion 130 is of generally stepped cylindrical configuration and is formed with a large diameter pilot piston region 134 which fits closely into the main bore 104 behind the O-ring 128, a central intermediate diameter region 136 having a drain control land 138 which fits closely inside the sleeve 126 between the drain and outlet recesses 114 and 118, and a small diameter forward region 140 which projects forwardly past the pressure recess 116. The pressure control portion 132 is essentially of cup shaped configuration and it has a skirt 142 which slides along the bore 104 in the vicinity of the front plate 106. The pressure control portion 132 steps down to form an annular sealing surface 144 which is moveable into sealing engagement with the forward edge of the sleeve 126. Radial openings 146 are provided in the pressure control portion 132 to maintain the bore region between the pressure control portion 132 and the front plate 106 at pump pressure. An axial opening 148 is provided in the vicinity of the annular sealing surface 144 to accommodate the forward region 140 of the drain control portion 130. A spring 152 extends between the pressure control portion 132 and the front plate 106 to bias the pressure control portion 132 toward engagement with the abutment 150 and toward sealing engagement between the annular sealing surface 144 and the sleeve 126.

The pilot bore 112 in the housing extension 110 is also formed with axially displaced annular drain, output and pressure recesses 154, 156 and 158. The drain and pressure recesses communicate with the drain and pressure lines 86 and 84 respectively, while the output line communicates via the control pilot line 80 with a pilot control chamber 160 formed in the main bore 104 between the pilot piston region 134 and the back plate 108. This forms the third pilot connection 82 to the main valve 54. The end of the pilot bore 112 closest to its pressure recess 158 is maintained in communication with the drain line 86 and forms the second pilot input 90. The opposite end of the pilot bore 112 forms a pilot chamber comprising the third pilot input 92 of the valve; and this chamber is maintained in communication with the pilot valve control line 94 and the pilot conduit 40.

A pilot spool 162 is axially moveable in the pilot bore 112. This pilot spool is formed with a larger diameter pressure control land 164 and a larger diameter drain control land 166 axially separated by a smaller diameter region 168. A still smaller diameter pilot portion 170 extends out beyond the pressure control land 164 and into the second pilot input 90. The pressure control land 164 is formed with radial openings 172 to insure that the diametrical area of the land in excess of that occupied by the pilot portion 170 is always exposed to pump pressure. This arrangement forms the first pilot input 88 (FIG. 1).

The pilot spool 162 is bored axially from its end facing the third pilot input 92 to an opening in the recess region 168. This forms the compensating feedback line 96 between the pilot valve output, i.e., the output recess 156 and the pilot input 92. Also the opening to the recess forms the flow limiting restriction 98.

The operational cycle of the valve assembly will be described in conjunction with FIGS. 3–6. In the condition shown in FIG. 3 the drive output port 124 is in communication with the pressure input port 122. This communication is maintained by the retraction to the right of the pressure control portion 132 of the spool valve assembly so that its annular sealing surface 144 is away from the sleeve 126 and the pressure input recess 116 and the common annular output recess 118 are open to each other. The pressure control portion is held retracted against the force of the bias spring 152 by the force of the abutment 150 on the face of the pressure control portion. The abutment 150, which forms a part of the drain control portion 130 of the valve spool assembly, is urged to the right by virtue of high fluid pressure maintained in the pilot control chamber 160. At the same time the drain control land 138 closes off the drain input recess 114 from the common output recess 118.

Although rather substantial differentials may exist between the applied pump and drain pressures, the valve spool portions 130 and 132 are only relatively lightly hydraulically held or latched in the positions shown in FIG. 3. Since both sides of the pressure control portion 132 are exposed to input or pump pressure the net hydraulic force on this portion is zero and only the resilient force of the spring 152 is needed to be overcome by the abutment 150 on the drain control portion 130. The net hydraulic force on the drain control portion 130 is equal to the product of the difference between pump and drain pressures on the one hand and the difference between the diametrical areas of the pilot piston region 134 and the drain control land 138 on the other hand. The difference between these diametrical areas need only be enough to produce sufficient force to overcome the bias force of the spring 152 and hold the valve elements in the position shown in FIG. 3.

Pump pressure is maintained in the pilot control chamber 160 by the pistioning of the pilot valve spool 162 in its uppermost position as shown in FIG. 3. In this position the pressure control land uncovers the pressure recess 158 and places it into open communication with the output recess 156 which in turn communicates with the pilot control chamber 160. At the same time the drain control land 166 blocks the drain recess 154 from communication with the output recess 156.

The pilot valve spool 162 is moved and held in its upper position by application of pressurized pilot fluid to its lower end. Now if any gradual flow of this pressurized pilot fluid should occur, which might allow downward movement of the spool 112, this flow will be compensated for by a gradual flow of pressurized fluid from the output recess 156, through the restriction 98 and the feedback line 96 to the end of the spool.

Figure 4:
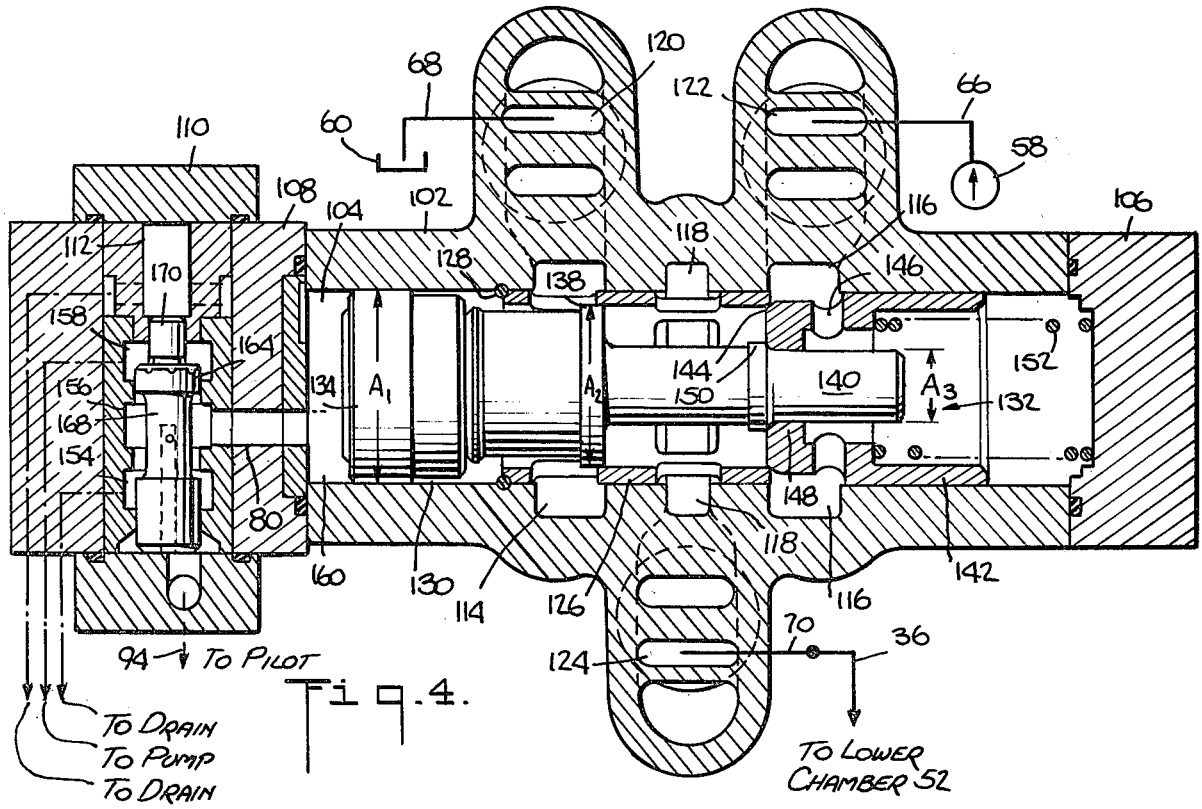

FIG. 4 illustrates a first stage in switching the valve assembly from the position of FIG. 3, i.e., where the drive output port 124 is connected to the pressure input port 122, to its opposite position, i.e., where the drive output port 124 is connected to the drain input port 120. In FIG. 4, it will be noted, the drain control portion 130 of the valve spool assembly has shifted to the left by an amount such that the pressure control portion 132 moves into sealing contact with the edge of the sleeve 126 to close the pressure input recess 116 from the common output recess 118. At this point, however, the drain control land 138 has not uncovered the drain input recess 114, so that the drive output port 124 is not connected to either the pressure or the drain ports 120 and 122. At this point the system is hydraulically locked. This insures that a recess closure overlap will occur so that the drain input recess 114 will never come into direct communication with the pressure input recess 116. Also when this switching takes place at the bottom of a hydraulic hammer stroke, the downwardly moving ram becomes instantaneously locked to the ram supporting framework at the moment of impact. This causes both the ram and its supporting framework to exert a downward hammering force on the pile or other element being driven and it prevents upward reaction movement of the supporting framework at the moment of impact.

It will be appreciated that by virtue of the split valve spool arrangement comprising the driven control portion 130 on the one hand and the pressure control portion 132 on the other hand, the system is inherently protected against pressure surges in excess of pump pressure. Should any such surges occur they will be transmitted back against the pressure control portion 132 causing it to open and accept a reverse fluid flow back toward the pump for so long as the pressure is maintained.

The switching of the valve portions 130 and 132 to the position of FIG. 4 is extremely rapid because at the time of such switching the pressure in the pilot control chamber is reduced to drain pressure while the pump pressure is present across the diametrical area defined by the drain control land 138. Thus, the net hydraulic force urging the drain control portion 130 to the left is equal to the product of the difference between pump and drain pressures on the one hand and the diametrical area defined by the drain control land on the other hand. Now when the drain control portion 132 moves completely to the left, as shown in FIG. 5, the land 138 uncovers the drain input recess 114 to place the drive output port 124 into fluid communication with the drain input port 120 while the pressure input port 122 remains blocked.

Figure 5:
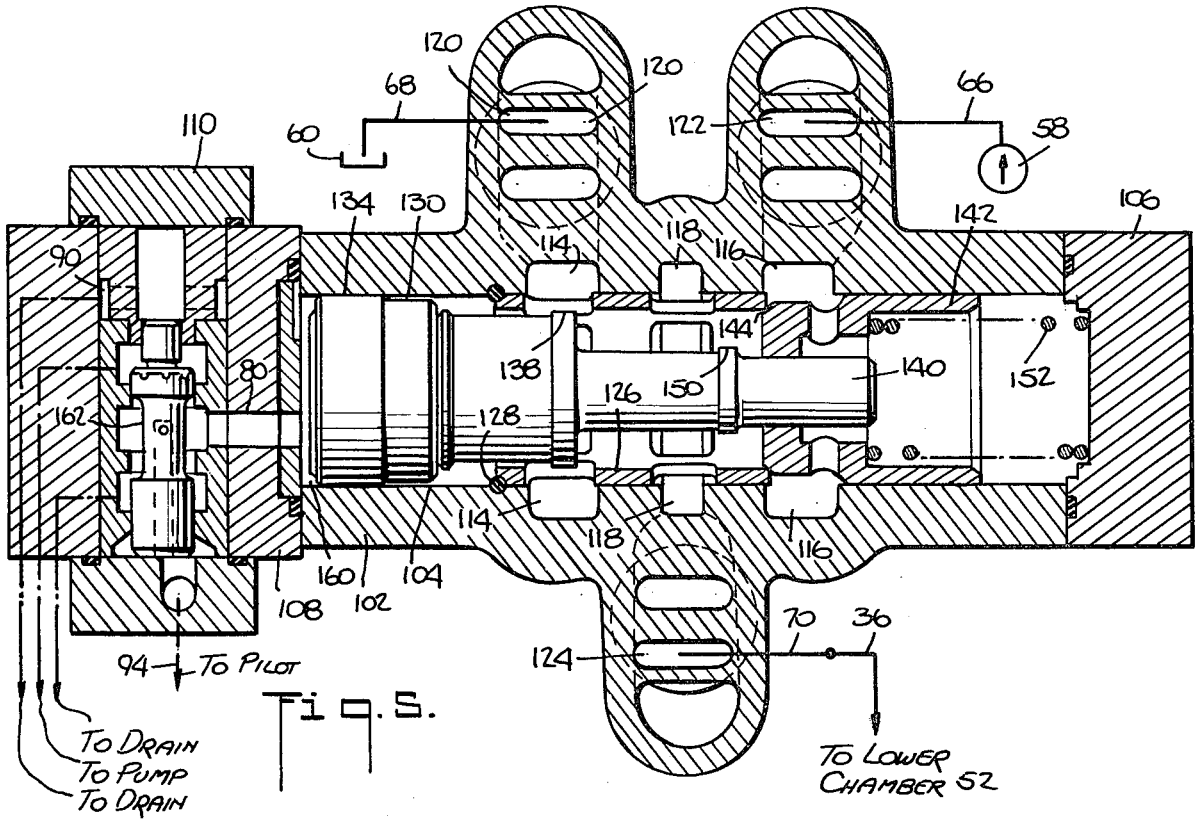

Once the valve has veen switched to the condition of FIG. 5 the large hydraulic driving forces acting rapidly shift the drain control valve spool portion 130 are substantially lessened. This is because the diametrical surface defined by the drain control land 138 is now largely (except for the portion extending through the axial opening 148 in the pressure control portion 132) exposed to drain pressure. Thus, the total hydraulic force now acting to hold the main valve spool drain control portion in its left hand position is equal to the product of the difference between pump and drain pressures on the one hand and the diametrical surface area defined by the forward region 140 of the drain control portion 130 on the other hand.

The switching of the fluid pressure in the pilot control chamber from pump pressure to drain pressure for moving the main valve spool assembly to the left, as shown in FIGS. 4 and 5, is achieved by shifting the pilot spool 162 downwardly as viewed in those drawings. This places the output recess 156 into communication with the drain recess 154 and it closes off the pressure recess 158. The pilot spool 162 is moved downwardly in response to the application of drain pressure to the pilot inlet 92 at its lower end. This causes the fluid at the lower end of the spool to be drawn out and the spool to shift downwardly. After the pilot spool has so shifted, its lower end will continue to be subjected to low pressure by communication through the compensating feedback line 96 to the now drain connected output recess 156. Also, should pilot leakage occur such that fluid begins to seep into the region below the end of the pilot spool 162 this fluid will be drained out through the feedback line 96 without movement of the spool. On the other hand, the spool will shift readily in response to a sudden substantial flow of fluid into it.

Figure 6:
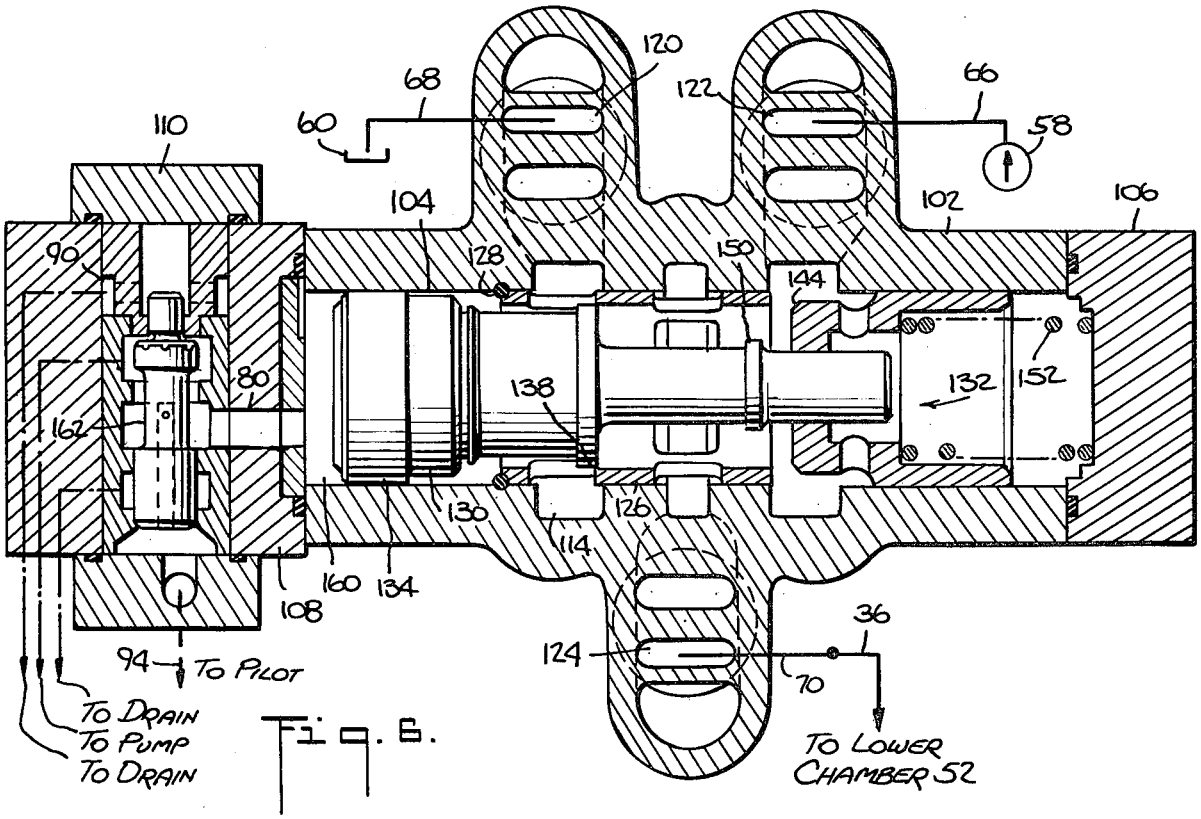

FIG. 6 illustrates the switching of the main valve spool arrangement back to the right for reconnecting the drive output and pressure input ports 124 and 122 when the pilot spool 162 is shifted upwardly. During the initial stages of the rightward movement of the drain control portion 130 its drain control land 128 closes off the drain input recess 114 before the abutment 150 contacts the face of the pressure control portion 132 to move it to uncover the pressure input recess 116. Thus, as in the case of leftward spool movement, there is a condition during rightward spool movement wherein the drive output port 125 is isolated from both the drain and pressure input ports 120 and 122. However, because the drain input port 120 was previously open to accept flow from the drive output port the sudden closure of the drain input port may result in a sudden surge of pressure due to the inertia of the moving mass, e.g., a hammer ram, causing the drain flow. This pressure surge is readily accomodated by the pressure control portion 132 which functions to open automatically and accept reverse flow back toward the pump whenever the pressure at the drive output port exceeds the pump pressure. Because of this it is possible safely to employ high hydraulic pressures to drive high inertial loads very rapidly. In the case of hydraulically driven hammers, the valve system of the present invention permits the switching of hydraulic forces to initiate downstroke ram movement at approximately the midpoint of the ram upstroke. This in turn permits maximum impact force at the bottom of the ram stroke for a given ram mass and stroke length and driving pressure.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by letters patent is:

1. In a hydraulically driven hammer system, a hydraulic piston and cylinder assembly and means for actuating said assembly for causing reciprocal relative movement between the piston and cylinder thereof, a support frame connected to a stationary part of said piston and cylinder assembly, a massive ram connected to a moveable part of said piston and cylinder assembly, said massive ram being guided by said frame for reciprocal relative movement therein, means forming outer hydraulic and inner hydraulic elements with the inner element located inside the outer element, one of said elements being fixed with respect to said frame and the other element being fixed with respect to said ram, said outer element being formed with an inner hydraulic chamber exposed to said inner element and maintained continuously open to a first hydraulic pressure, one of said elements being formed with a land which slides along the other element and which separates said chamber from a region maintained continuously open to a second pressure, a pilot conduit formed in said other element and opening out to the surface thereof facing said land for successive exposure to said first and second pressures as said ram undergoes reciprocal movement and hydraulic switching means operative in response to exposure of said pilot conduit to said first pressure to drive said ram in a direction causing the pilot conduit to become exposed to said second pressure, and vice versa, whereby said ram undergoes reciprocal movement.

2. A hammer according to claim 1 wherein said hydraulic piston and cylinder assembly is of the differential type having a piston member fitted into and dividing the interior of a cylinder member into chambers of different diametrical area, the smaller chamber being maintained at said first hydraulic pressure and the larger chamber being switched betweeen different pressures, a pressure separating land formed on one of said members and slideable along the other member and separating said smaller chamber from a region maintained at said second constant pressure.

3. A hammer system according to claim 2 wherein said cylinder member is connected to said ram for movement therewith and wherein said land is formed on said cylinder member near one end thereof.

4. A hammer system according to claim 2 wherein said system includes an outer casing secured to said frame within which said cylinder member moves, the interior of said outer casing being filled with fluid maintained at said second pressure.

5. A hammer system according to claim 1 wherein said hydraulic switching means includes a hydraulic switching valve having a fluid operated pilot connected to said pilot conduit, said valve being switchable in reponse to the presence of said first and second pressures at its pilot to connect its output with sources of said first and second pressure respectively and a restrictive flow feedback conduit connected between said output and said pilot.

6. In a hydraulically driven hammer system a hydraulic piston and cylinder assembly means including a hydraulic valve for actuating said assembly for causing reciprocal relative movement between the piston and cylinder thereof, a support frame connected to a stationary part of said piston and cylinder assembly, a massive ram connected to a movable part of said piston and cylinder assembly, said massive ram being guided by said frame for reciprocal relative movement therein, said hydraulic valve having a fluid operated pilot which switches the valve in response to the application thereto of a given pressure, pilot means which controls operation of said hydraulic valve in response to movements of said ram, said pilot means comprising a land and means forming a surface over which the land moves, said land and said surface cooperating to separate a region of said given pressure from a region of different pressure, a pilot conduit having an opening onto said surface and extending therefrom to said fluid operated pilot, a said land and said means forming said surface being relatively movable upon movement of said ram with respect to said frame so that said land covers and uncovers said pilot opening and alternately exposes said pilot opening to said region of given pressure and said region of different pressure, and a restrictive flow conduit extending from said source of different pressure to said pilot while said land covers said conduit and until said pilot opening becomes exposed to said source of given pressure, said restrictive flow conduit providing substantially more restriction to fluid flow than said pilot conduit, whereby when said pilot opening is covered by said land, and while said ram is moving in a direction such that said pilot opening will become exposed to said given pressure, the resulting leakage through said pilot opening and through the finite clearance between said land and said surface is compensated by a corresponding flow through said restrictive flow conduit to prevent premature switching, but when said opening becomes exposed fully to said region of given pressure, the resulting greater flow through said pilot conduit operates to switch the valve.

7. A hammer system according to claim 6 wherein said restrictive flow conduit includes a restriction limiting fluid flow therethrough to a rate corresponding to the rate of leakage of fluid through the pilot conduit opening at said land.

8. In a hydraulically driven hammer system, a hydraulic piston and cylinder assembly and means for actuating said assembly for causing reciprocal relative movement between the piston and cylinder thereof, a massive ram connected to a moveable part of said piston and cylinder assembly, said massive ram being guided by a frame for reciprocal relative movement therein, a switching valve for sequentially connecting a chamber in said piston and cylinder assembly to sources of higher and lower pressure to reciprocally move said ram in hammering and retraction directions, respectively, said valve comprising a housing formed with a internal bore, first and second inputs from said source of higher and lower pressure respectively and opening into said internal bore at spaced apart locations, an output connected to said piston and cylinder assembly chamber and opening into said internal bore at a location between said first and second inputs, a first valve spool element moveable reciprocally in said bore for covering and uncovering said first input, a second valve spool element also moveable reciprocally in said bore for covering and uncovering said second input, an abutment spacer in said bore for maintaining said spool elements sufficiently far apart so as not to allow said spool elements to cover said output, said abutment spacer being of sufficient length to communicate movement of said second valve spool element, beyond its input closing position, to said first valve spool element to move same to an input opening position, said first spool element being biased on an input closing position and means for actuating said second valve spool element to move back and forth in said bore in response to predetermined movements of said ram.

9. A hammer system according to claim 8 wherein said hammer system is arranged to cause said switching valve to connect said higher pressure source to said piston and cylinder assembly chamber during downward ram movement and wherein said system includes means for effecting movement of said second spool element to an input closing position prior to opening of said first input at the end of said downward movement.

10. A hydraulically driven hammer system according to claim 6, wherein said fluid operated pilot switches said hydraulic valve to a first condition in response to the application thereto of said given pressure and wherein said fluid operated pilot switches said hydraulic valve to a second condition in response to the application thereto of said different pressure.

11. A hydraulically driven hammer system according to claim 10, wherein said hydraulic valve is arranged to actuate said piston and cylinder assembly in a direction such that the distance between the pilot conduit opening and said region of given pressure decreases following switching of the hydraulic valve to its said second condition and to actuate said piston and cylinder assembly in a direction such that the distance between the pilot conduit opening and said region of different pressure decreases following switching of the hydraulic valve to its said first condition.

12. A hydraulically driven hammer system according to claim 11, wherein said hydraulic valve includes an output connected to be exposed to said given pressure when said valve is in its said first condition and to be exposed to said different pressure when said valve is in its said second condition and wherein said restrictive flow conduit extends between said output and said pilot.

* * * * *

UNITED STATES PATENT OFFICE

CERTIFICATE OF CORRECTION

Patent No. 4,026,193 Dated May 31, 1977

Inventor(s) Peter B. Olmsted

It is certified that error appears in the above-identified patent and that said Letters Patent are hereby corrected as shown below:

Title page, line [21], "570,425 to read -- 507,425;

Column 2, line 55, "an" to read -- and --;

Column 3, line 26, "cential" to read -- central --;

Column 5, line 55, "raam" to read -- ram --;

Column 6, line 36, after "pilot" insert -- input --;

Column 10, line 27, "veen" to read -- been --;

Column 12, line 45, delete the word "a".

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*